US010844713B2

(12) United States Patent
Kirkhope

(10) Patent No.: US 10,844,713 B2
(45) Date of Patent: Nov. 24, 2020

(54) SHEARING SYSTEM FOR LONGWALL MINING

(71) Applicant: Caterpillar Global Mining Europe GmbH, Lünen (DE)

(72) Inventor: Euan Russell Kirkhope, Waratah (AU)

(73) Assignee: Caterpillar Global Mining Europe GmbH, Lunen (DE)

( * ) Notice: Subject to any disclaimer, the term of this patent is extended or adjusted under 35 U.S.C. 154(b) by 0 days.

(21) Appl. No.: 16/519,609

(22) Filed: Jul. 23, 2019

(65) Prior Publication Data

US 2020/0049004 A1 Feb. 13, 2020

(30) Foreign Application Priority Data

Aug. 7, 2018 (GB) ..... 1812808.2

(51) Int. Cl.

| | |
|---|---|
| ***E21C 35/12*** | (2006.01) |
| ***E21C 25/68*** | (2006.01) |
| *E21C 25/06* | (2006.01) |
| *E21C 25/16* | (2006.01) |
| *E21C 27/32* | (2006.01) |
| *E21C 41/16* | (2006.01) |

(52) U.S. Cl.

CPC ..... *E21C 25/68* (2013.01); *E21C 35/12* (2013.01); *E21C 25/06* (2013.01); *E21C 25/16* (2013.01); *E21C 27/32* (2013.01); *E21C 41/16* (2013.01)

(58) Field of Classification Search

CPC ..... E21F 17/18; E21C 35/12; E21C 35/24
See application file for complete search history.

(56) References Cited

U.S. PATENT DOCUMENTS

| | | | | |
|---|---|---|---|---|
| 4,634,186 | A * | 1/1987 | Pease | E21C 35/24 299/1.6 |
| 4,884,847 | A | 12/1989 | Bessinger et al. | |
| 7,549,709 | B2 | 6/2009 | Kussel | |
| 8,672,414 | B2 | 3/2014 | Junker et al. | |
| 2012/0098325 | A1 | 4/2012 | Junker et al. | |
| 2016/0061035 | A1* | 3/2016 | Siegrist | E21C 25/06 340/686.1 |

FOREIGN PATENT DOCUMENTS

| | | | |
|---|---|---|---|
| GB | 2226348 | A | 6/1990 |
| GB | 2254869 | A * | 10/1992 |
| WO | WO 2009/103306 | A1 | 8/2009 |

OTHER PUBLICATIONS

Search Report for related United Kingdom Application No. 1812808.2; report dated Jan. 28, 2019.

* cited by examiner

*Primary Examiner* — Sunil Singh
(74) *Attorney, Agent, or Firm* — Miller, Matthias & Hull
Hibshman Claim Construction PLLC

(57) ABSTRACT

A shearing system includes a pan line having an end stop, a gate end, and a set of consecutively arranged pans extending from the gate end and having one or more pans disposed beyond the end stop. A shearer is stoppable at the end stop, includes a shearer arm, and is positioned on the one or more pans when the shearer arm is disposed between the end stop and the gate end. A first sensor detects an orientation of the shearer, while second sensors detect an orientation of the set of consecutively arranged pans. A control system determines a profile of the pan line between the end stop and the gate end and controls a movement of the shearer arm based on the profile of the pan line when the shearer arm is disposed between the end stop and the gate end.

20 Claims, 3 Drawing Sheets

SHEARING SYSTEM FOR LONGWALL MINING

TECHNICAL FIELD

The present disclosure generally relates to shearing systems for longwall mining. More particularly, the disclosure relates to determining a profile of a set of pans of a pan line of a longwall mining machine by using sensors, such as inclinometers.

BACKGROUND

Longwall mining operations generally apply a shearer that traverses along an armored face conveyor pan line (or simply a pan line) to shear and mine material from a mine face. For example, shearers include a shearer arm that may be applied to shear material from the mine face. Shearers generally include a sensor, such as an inertial navigation system (INS), that facilitates measurement of an orientation of the shearer, and, thus a profile of the pan line. Because of the generally elongated profile of the shearer, the shearer is typically unable to travel all the way to the ends of the pan line (or to a main gate end and a tail gate end of the pan line). As a result, a profile of the ends of the pan line generally remain undetected, and generally are extrapolated, for example, using gate end stop point position's pitch angles. However, the extrapolated profile of the ends of the pan line may misrepresent an actual profile of the ends of the pan line, often leading to incorrect shearer arm placement at the ends of the pan line (i.e., at the main gate end or the tail gate end).

WIPO Application No. 2009103306 ('306 reference) relates to a method for stabilizing longwall coal mining operations. The '306 reference discloses a conveyor that includes a tilt sensor providing data regarding the conveyor's position.

SUMMARY OF THE INVENTION

In one aspect, the disclosure is directed towards a shearing system for longwall mining. The shearing system includes a pan line, a shearer, and a control system. The pan line is defined by multiple interconnected pans. The pan line includes an end stop, a gate end, and a set of consecutively arranged pans extending from the gate end and having one or more pans disposed beyond the end stop, away from the gate end. The shearer is moveable on and along the pan line and is configured to stop at the end stop. The shearer includes a shearer arm that is configured to be moved to remove mine material from a mine face. The shearer is positioned on the one or more pans when the shearer arm is disposed between the end stop and the gate end. The shearer also includes a first sensor that is configured to detect an orientation of the shearer. The shearing system includes a set of second sensors each configured to detect an orientation of a pan of the set of consecutively arranged pans. Further, the control system is configured to: determine a profile of the pan line between the end stop and the gate end based on the orientation of one or more pans of the set of consecutively arranged pans and the orientation of the shearer when the shearer arm is disposed between the end stop and the gate end. The controller system is further configured to control a movement of the shearer arm based on the profile of the pan line when the shearer arm is disposed between the end stop and the gate end.

In another aspect, the disclosure relates to a method for operating a shearer of a longwall mining machine. The method includes receiving, by a control system, data corresponding to an orientation of the shearer moveable on and along a pan line and data corresponding to an orientation of a set of consecutively arranged pans extending from a gate end of the pan line. The set of consecutively arranged pans have one or more pans disposed beyond an end stop of the pan line, away from the gate end. The method further includes determining, by the control system, a profile of the pan line between the end stop and the gate end based on the orientation of one or more pans of the set of consecutively arranged pans and the orientation of the shearer when a shearer arm of the shearer is disposed between the end stop and the gate end. The method additionally includes controlling, by the control system, a movement of the shearer arm based on the profile of the pan line when the shearer arm is disposed between the end stop and the gate end.

In yet another aspect the disclosure is directed to a shearing system for longwall mining. The shearing system includes a pan line, a shearer, a set of inclinometers, and a control system. The pan line is defined by a plurality of interconnected pans. The pan line includes an end stop, a gate end, and a set of consecutively arranged pans extending from the gate end and having one or more pans disposed beyond the end stop, away from the gate end. The shearer is moveable on and along the pan line and is configured to stop at the end stop. The shearer includes a shearer arm and an inertial navigation system. The shearer arm is configured to be moved to remove mine material from a mine face. The shearer is positioned on the one or more pans when the shearer arm is disposed between the end stop and the gate end. The inertial navigation system is configured to detect an orientation of the shearer. The set of inclinometers are coupled to the set of consecutively arranged pans and each configured to detect an orientation of a pan of the set of consecutively arranged pans. Further, the control system is configured to determine a profile of the pan line between the end stop and the gate end based on the orientation of one or more pans of the set of consecutively arranged pans and the orientation of the shearer when the shearer arm is disposed between the end stop and the gate end. The control system is further configured to control a movement of the shearer arm based on the profile of the pan line when the shearer arm is disposed between the end stop and the gate end.

DETAILED DESCRIPTION

Figure 1:
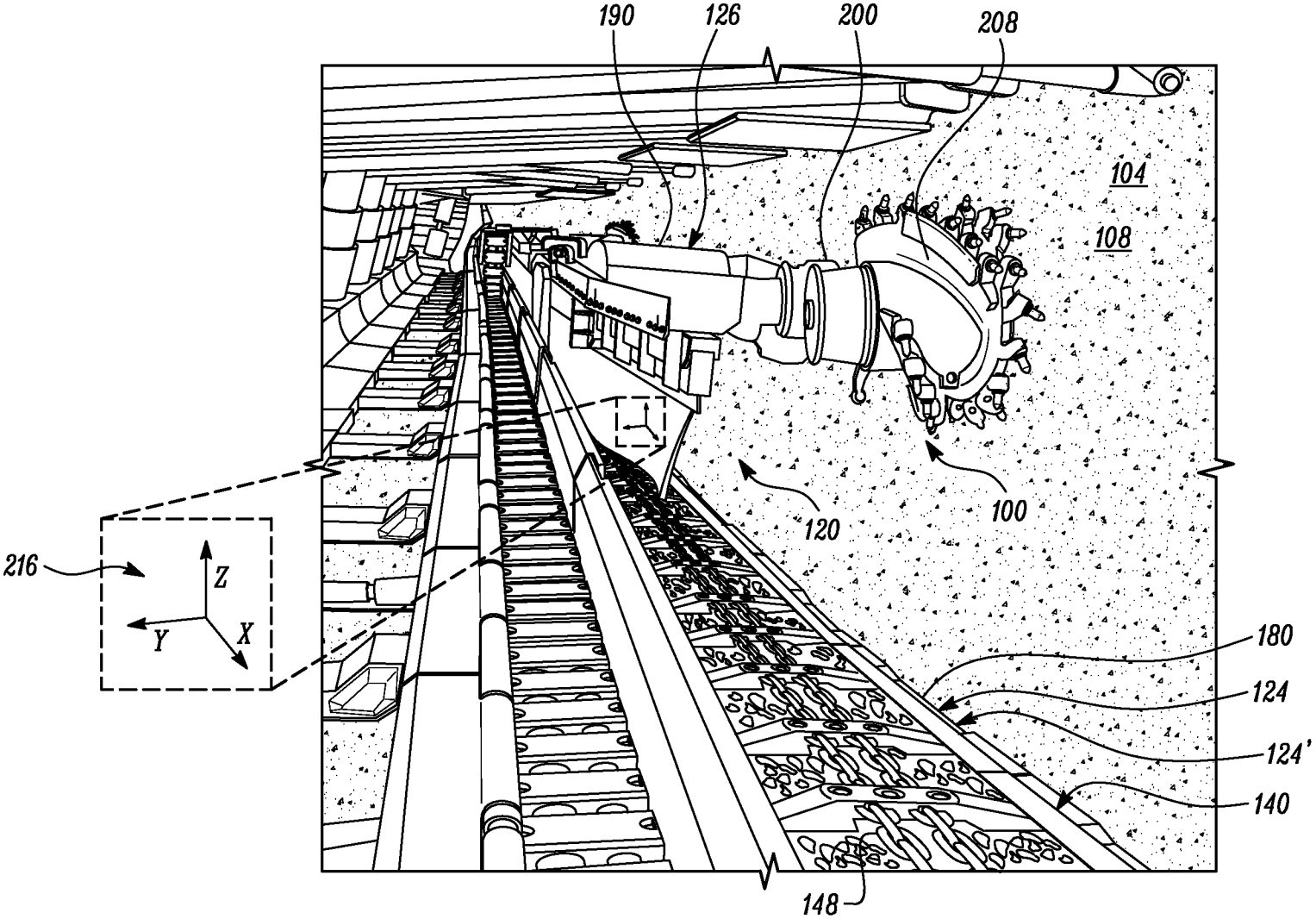
FIG. 1 is an exemplary longwall mining machine that includes a shearer movable along a pan line to extract material from a mine face of an underground mine, in accordance with an embodiment of the present disclosure.

Referring to FIG. 1, a longwall mining machine 100 is shown. The longwall mining machine 100 may be operated within an underground mine 104 to remove mine materials, such as coal, from a mine face 108 of the underground mine 104. Nevertheless, aspects of the present disclosure may be applied to other environments, and may not be limited to the environment set forth in the following description and/or drawings. The longwall mining machine 100 may include a shearing system 120 having a face conveyor 124, a shearer 126, and a control system 128 (see FIG. 2).

Figure 2:
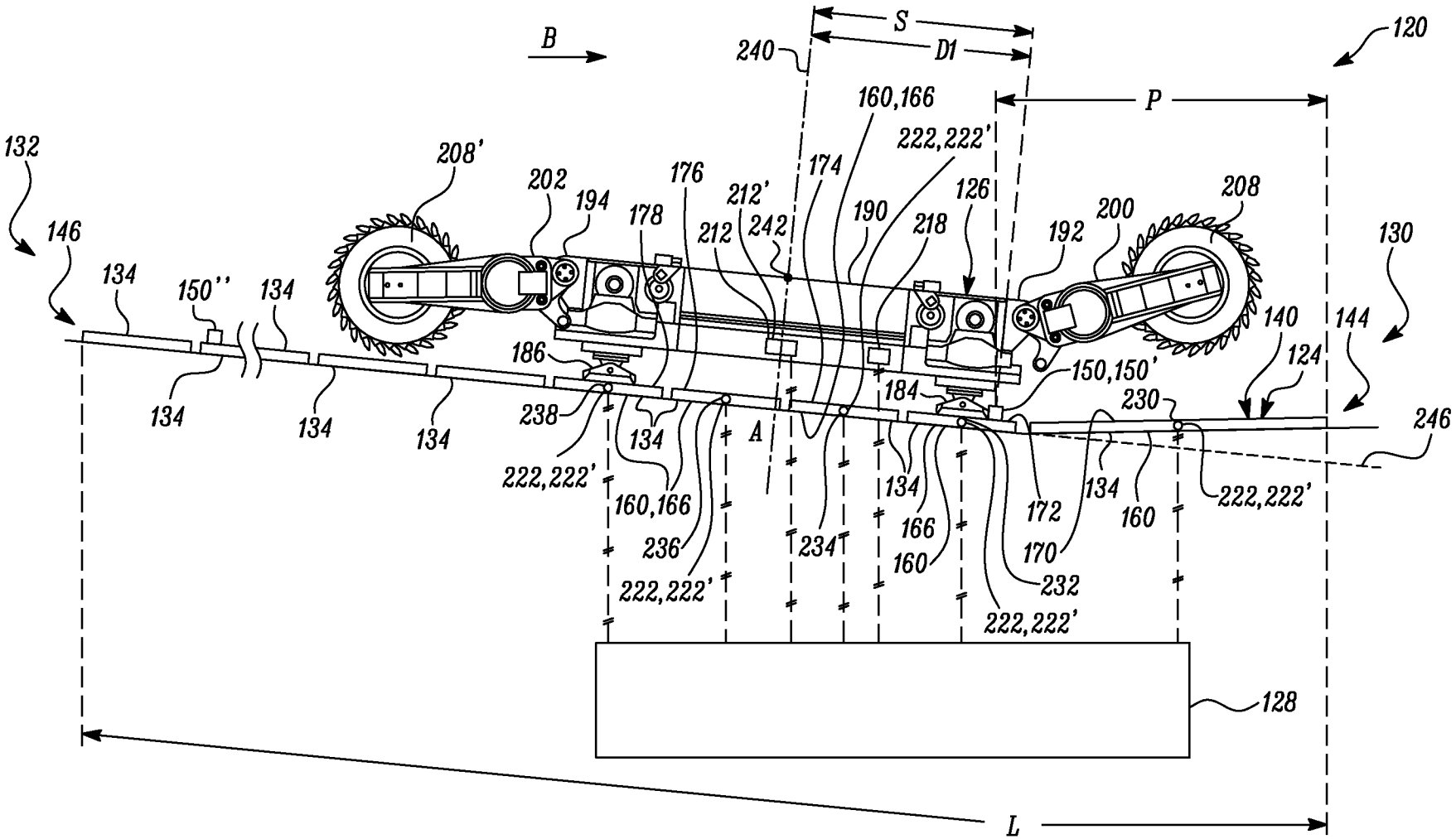
FIG. 2 is a diagrammatic view of a shearing system applied within the longwall mining machine, in accordance with an embodiment of the present disclosure.

Referring to FIGS. 1 and 2, the face conveyor 124 may be an armored face conveyor 124', and may be disposed and extended along the mine face 108 of the underground mine 104. For example, the face conveyor 124 may extend between a main gate 130 and a tail gate 132 (see exemplified annotations in FIG. 2) of the underground mine 104. The face conveyor 124 may include multiple face conveyor segments, referred to as pans 134. Adjacent pans 134 may be coupled to one another, and multiple interconnected pans 134 may define a pan line 140 of the shearing system 120. The pan line 140 may define a main gate end 144 (disposed in relative proximity to the main gate 130) and a tail gate end 146 (disposed in relative proximity to the tail gate 132). In some examples, the pan line 140 may be arranged in-between two stations (not shown), which may respectively accommodate sprockets, and the like, to help redirect an endless conveyor chain 148 of the face conveyor along a cyclical path, as is commonly found in conveyor mechanisms. In that manner, the face conveyor 124 is able to transport material extracted and dropped from the mine face 108 to a suitable location. An operation of the endless conveyor chain 148 may be powered by one or more drives (commonly referred to as a main drive and/or an auxiliary drive) (not shown).

Referring to FIG. 2, and in some embodiments, the pan line 140 includes a first end stop 150' and a second end stop 150". The first end stop 150' may be disposed at (or adjacent to) the main gate end 144 of the pan line 140, while the second end stop 150" may be disposed at (or adjacent to) the tail gate end 146 of the pan line 140. Both the first end stop 150' and the second end stop 150" serve to restrict and/or limit a movement of the shearer 126 over and along the pan line 140. Accordingly, the shearer 126 may travel along the pan line 140 anywhere between the first end stop 150' and the second end stop 150". Certain aspects of the present disclosure have been discussed in relation to the main gate end 144 of the pan line 140, and, for ease, the main gate end 144 may be simply referred to as gate end 144 and the first end stop 150' may be simply referred to as end stop 150. Discussions related to the end stop 150 and the gate end 144 may be respectively and equitably applied to the second end stop 150" and the tail gate end 146 of the pan line 140. Further, a section of the pan line 140 disposed between the end stop 150 and the gate end 144 may be referred to as a section, P.

With reference to FIG. 2, and according to an aspect of the present disclosure, the pan line 140 includes a set of consecutively arranged pans 160 extending from the gate end 144 towards the end stop 150. The set of consecutively arranged pans 160 have one or more pans 166 disposed beyond the end stop 150, away from the gate end 144. For ease, the set of consecutively arranged pans 160 are referred to as end pans 160. The end pans 160 may include a first pan 170, a second pan 172, a third pan 174, a fourth pan 176, and a fifth pan 178. The first pan 170 may be the first to extend from the gate end 144 towards the end stop 150. The second pan 172 may extend from where the first pan 170 ends, and, successively, the remaining end pans 160, i.e., the third pan 174, the fourth pan 176, and the fifth pan 178, may extend in sequential progression along a further defined profile of the pan line 140. In the depicted example, the end stop 150 is positioned atop the second pan 172, and thus, may act a stopper for limiting shearer movement up to a position on the second pan 172, thereby restricting shearer travel all the way to the gate end 144 (or over onto the first pan 170). In some embodiments, it is possible for the end stop 150 to be positioned atop other end pans 160, as well, and the configuration of the end stop 150 positioned atop the second pan 172 need to be viewed as being simply exemplary. For example, the end stop 150 may be positioned atop any of the third pan 174, the fourth pan 176, and the like. In some embodiments, the end stop 150 may be coupled and positioned elsewhere. For example, the end stop 150 may be coupled to a frame (not shown) of the face conveyor 124. Furthermore, although five end pans 160 have been disclosed, lesser or additional number of end pans 160 may be contemplated.

In some embodiments, the pan line 140 includes a guide rail 180 (see FIG. 1) (not annotated in FIG. 2 to save clarity). The guide rail 180 may be integrally formed with the pan line, and thus, may be defined and extended along a length, L, of the pan line 140. The guide rail 180 may facilitate a movement of the shearer 126 along the pan line 140, following a profile of the pan line 140—this means that as a profile of the pan line 140 within the underground mine 104 may follow the undulations, curves, bends, highs, and lows of the profile of the underground mine 104, so may the guide rail 180 define and follow the same profile as that of the pan line 140. Further, as with the extents of the pan line 140, the guide rail 180 may terminate proximate to each of the main gate 130 and the tail gate 132 of the underground mine 104.

The shearer 126 may include a generally elongated, main body 190, with a first body end 192 and a second body end 194 disposed opposite to the first body end 192. The shearer 126 may include a first shearer arm 200 coupled and moveable relative to the first body end 192, and a similarly arranged, second shearer arm 202 coupled and movable relative to the second body end 194. The first shearer arm 200 may include a cutting drum 208 that may be moved to engage the mine face 108, and/or may be rotated about an axis (not shown) upon engagement with the mine face 108. In that manner, the cutting drum 208 may help shear and extract material from the mine face 108. A cutting drum 208' similar to the cutting drum 208 may be provided on the second shearer arm 202, as well.

The shearer 126 may be moved along the pan line 140 to shear and remove mine material, such as coal, from the mine face 108, as already noted above. To this end, the shearer 126 may be guided and traversable on and along the guide rail 180, along the length, L, of the pan line 140. To enable shearer travel over the guide rail 180, the shearer 126 may include shoes, for example, a first shoe 184 and a second shoe 186. Both the first shoe 184 and the second shoe 186 may be in slidable engagement relative to the guide rail 180 (or the pan line 140) to facilitate shearer travel along the pan line 140. Additional (or lesser) number of shoes (such as shoes 184, 186) may be contemplated. During shearer travel, as the shearer 126 may travel towards the gate end 144, the first shoe 184 may move and abut against the end stop 150 and may halt a further travel of the shearer 126 towards the gate end 144.

It may be noted that when the first shoe 184 may abut (or be relatively close to) the end stop 150, the shearer arm 200 may extend beyond the end stop 150 and may be disposed between the end stop 150 and the gate end 144, as shown in FIG. 2. Such a position of the shearer 126 may be termed as a 'main gate position' of the shearer 126. In the main gate position of the shearer 126, the shearer arm 200 of the shearer 126 may be able to shear material from a portion of the mine face 108 that is situated (or that generally takes a position) in between the end stop 150 and the gate end 144. Further, in the main gate position of the shearer 126, the shearer 126 may be positioned on one of the pans 166. In this regard, the main body 190 of the shearer 126 (or the shearer 126 itself) may define a central vertical axis 240 that passes through a mid-point 242 of a length of the shearer 126. As an example, the central vertical axis 240 may pass centrally between the first shoe 184 and the second shoe 186, and may be perpendicular to the length of the shearer 126. It is contemplated that a pan 166 through which the central vertical axis 240 may pass, in the main gate position of the shearer 126, may be considered as the pan 166 on which the shearer 126 is positioned. More explicitly, as shown in FIG. 2, the shearer 126 is at a position on the pan line 140 where the central vertical axis 240 has partly cleared the fourth pan 176, and stops short of moving over to the third pan 174. At this point, since the central vertical axis 240 passes through the fourth pan 176, the shearer 126 may be understood to be positioned on the fourth pan 176.

In the depicted example and position of the shearer 126 in FIG. 2, a gap exists between the first shoe 184 and the central vertical axis 240, and, accordingly, as and when the first shoe 184 abuts against the end stop 150 (i.e., in the main gate position of the shearer 126), a gap, D1, may be defined between the end stop 150 and a point (see point, A, FIG. 2) where the central vertical axis 240 may virtually meet the profile of the pan line 140. A section of the pan line 140 spanning the gap, D1, may be referred to as section, S. It may also be noted that when the first shoe 184 abuts against the end stop 150 (i.e., in the main gate position of the shearer 126), a length defined by the pans 166 extends up to at least a mid-point (i.e., mid-point 242 or point, A) of the length of the shearer 126. In the depicted embodiment, it may be noted that the pans 166 (i.e., the fourth pan 176 and the fifth pan 178) extend beyond the mid-point (i.e., mid-point 242 or point, A) of the length of the shearer 126, towards the tail gate end 146 of the pan line 140.

The shearer 126 is further equipped with an orientation sensor, referred to as a first sensor 212, to detect an orientation (e.g., yaw, roll, pitch, or an angular alignment) of the shearer 126 vis-à-vis the pan line 140. As an example, the first sensor 212 includes an inertial navigation system (INS) 212'. To understand the aspect of shearer orientation (e.g., yaw, roll, pitch of the shearer 126 vis-à-vis the pan line 140), a 3-dimensional co-ordinate system 216, as marked in FIG. 1 relative to the shearer 126, is explicitly referenced. The 3-dimensional co-ordinate system 216 includes an X-axis, a Y-axis, and a Z-axis. It may be noted that the Z-axis is a vertical axis (i.e., defined along an elevation) of the shearer 126; the X-axis is a horizontal axis (i.e., defined along the length, L, of pan line 140), and is perpendicular to the Z-axis; the Y-axis is perpendicular to both the X-axis and the Z-axis and may pass through a point of intersection of the X-axis and the Z-axis. For the purposes of the present disclosure, a yaw of the shearer 126 may mean a tilting of the shearer 126 about the Z-axis; a roll of the shearer 126 may mean a tilting of the shearer 126 about the X-axis; and a pitch of the shearer 126 may mean a tilting of the shearer 126 about the Y-axis. In an embodiment, an orientation of the shearer 126 as gauged by the first sensor 212 also helps in determining (or is indicative of) an orientation of any of the pans 134 on which the shearer 126 is positioned. For example, in the main gate position of the shearer 126, a detection of an orientation of the shearer 126 also facilitates a determination of an orientation of the fourth pan 176.

Additionally, or optionally, the shearer 126 may be equipped with a position sensor 218 (or one or more position sensors) that may help determine a position of the shearer 126 on and along the pan line 140. For example, a distance moved by the shearer 126 from a point, such as from the main gate end 144 or from a tail gate end 146 may be gauged by receiving an input from the position sensor 218. Further, input from the position sensor 218 may also be used to determine a speed and a direction of shearer movement along the pan line 140. According to one aspect of the present disclosure, an orientation of the shearer 126, as determined by the first sensor 212, and a position of the shearer 126, as determined by the position sensor 218, may be used to measure and determine a profile of the pan line 140.

In some embodiments, an orientation/position of the shearer 126 may be gathered relative to the central vertical axis 240 of the shearer 126. For example, data (or input) provided by the first sensor 212 and the position sensor 218 may be representative of an orientation/position of the central vertical axis 240 of the shearer 126. Accordingly, since the central vertical axis 240 of the shearer 126 (or the shearer 126 itself) may stop short of traversing over the section, S, (and/or section, P) an orientation of section, S, (and/or section, P) may remain non-detectable by the first sensor 212 (and/or the position sensor 218).

According to an aspect of the present disclosure, the shearing system 120 includes a set of second sensors 222. The second sensors 222 are configured to detect an orientation of the end pans 160. As an example, the second sensors 222 are coupled to the end pans 160, with at least one second sensor 222 being coupled to one end pan 160. For example, the second sensors 222 include inclinometers 222', and one inclinometer 222' may be coupled to one end pan 160. In this regard, the inclinometers 222' may include a first inclinometer 230, a second inclinometer 232, a third inclinometer 234, a fourth inclinometer 236, and a fifth inclinometer 238. The first inclinometer 230 may be coupled to the first pan 170, the second inclinometer 232 may be coupled to the second pan 172, the third inclinometer 234 may be coupled to the third pan 174, the fourth inclinometer 236 may be coupled to the fourth pan 176, and the fifth inclinometer 238 may be coupled to the fifth pan 178. It is nevertheless possible for the second sensors 222 to include other sensor types, such as proximity sensors, accelerometers, gyroscopes, and the like, either singularly or in combination with the inclinometers 222' or in combination with each other, for sensing an orientation of the end pans 160.

The control system 128 is communicably coupled to the first sensor 212, and to each of the second sensors 222 (e.g., to each of the inclinometers 222'). The control system 128 may also be communicably coupled to the position sensor 218. In that manner, the control system 128 may be configured to receive data (or input) from the first sensor 212, the position sensor 218, and from the second sensors 222. Data (or input) from the first sensor 212 helps the control system 128 determine the orientation (i.e., pitch, roll, and yaw) of the shearer 126. Data (or input) from the position sensor 218 helps the control system 128 determine a position of the shearer 126 and/or a distance traversed by the shearer 126 over and along the pan line 140. In some embodiments, data from both the first sensor 212 and the position sensor 218 may be used by the control system 128 to compute the profile of the pan line 140.

In one example, to determine the profile of the pan line 140, the control system 128 may generate a shearer path by computing an elevation profile (i.e., vector of shearer height changes along Z-axis) and pitch profile (i.e., vector of shearer distance changes about Y-axis) using the data/input from both the first sensor 212 and the position sensor 218. The shearer path may help define a terrain map in 3D space. The terrain map may represent the orientation of each pan 134, helping the control system 128 compute and generate the profile of the pan line 140.

In some embodiments, it may be noted that the control system 128 may detect an orientation of only those pans 134 that are partly or fully cleared (i.e., passed over) by the central vertical axis 240 of the shearer 126, during shearer travel over the pan line 140. So, while it is possible for the control system 128 to determine the profile of the pan line 140 based on the travel of the shearer 126 over the general expanse of the pan line 140, the pan line 140's profile may be computed (by using data (or input) from the first sensor 212/position sensor 218) only up to the position attained by the central vertical axis 240 when the first shoe 184 is abutted with the end stop 150. Since in the main gate position of the shearer 126, the fourth pan 176 is partly cleared by the shearer 126, the control system 128 may be able to generate a profile of the pan line 140 up to the fourth pan 176 when moving according to direction, B (see FIG. 2).

To measure and/or compute an orientation of the third pan 174, the second pan 172, and the first pan 170, the control system 128 utilizes data (or input) from the second sensors 222. A correspondence of the control system 128 with the first sensor 212, second sensor 222, and the position sensor 218, and aspects related to a corresponding working of the control system 128 will be set out later in the disclosure.

In some embodiments, data (or input) from the first sensor 212/position sensor 218 may be applied by the control system 128 to measure a profile of the pan line 140 up to the first shoe 184. In such a case, it is possible for the data (or input) provided by the first sensor 212 to be representative of an orientation of any other shearer axis that is at an offset to the central vertical axis 240. For example, such a shearer axis (not shown) may be disposed closer to the first body end 192 than to the second body end 194, or may be disposed closer to the second body end 194 than to the first body end 192. In one example scenario, if such a shearer axis were defined closer to the first body end 192, and, for example, if the shearer axis were to coincide with the first shoe 184 (or with the end stop 150), then gap, D1, may be virtually non-existent, and so may the section, S, be non-existent, as well. In such a case, the control system 128 may be able to determine a profile of the pan line 140 up to the point where the first shoe 184 meets the end stop 150 (i.e., or up to the second pan 172) solely based on the orientation and position of the shearer 126 since the profile of the pan line 140 up to the end stop 150 may be calculable by the representation provided by such a shearer axis. Further, the profile of the section, P, disposed beyond the first shoe 184 (or the end stop 150) towards the gate end 144 may remain non-computable by input from the first sensor 212/position sensor 218.

The control system 128 may be connected to the longwall mining machine 100's electronic control module (ECM) (not shown), such as a safety module or a dynamics module, or may be configured as a stand-alone entity. Optionally, the control system 128 may be integral and be one and the same as the ECM. The control system 128 may include a set of volatile memory units such as a random-access memory (RAM)/a read-only memory (ROM), which include associated input and output buses. More particularly, the control system 128 may be envisioned as an application-specific integrated circuit, or other logic devices, which provide controller functionality, and such devices being known to those with ordinary skill in the art. In one example, it is possible for the control system 128 to include one or more controllers having separate or integrally configured processing units to process a variety of data (or input) received from each of the first sensor 212, second sensors 222, and the position sensor 218. Further, the control system 128 may also include one or more internally (or externally) configured memory units. Further, the control system 128 may be optionally suited for accommodation within certain machine panels or portions from where the control system 128 may remain accessible for ease of use, service, and repairs.

Processing units within the control system 128 may include processors, examples of which may include, but are not limited to, an X86 processor, a Reduced Instruction Set Computing (RISC) processor, an Application Specific Integrated Circuit (ASIC) processor, a Complex Instruction Set Computing (CISC) processor, an Advanced RISC Machine (ARM) processor or any other processor. Examples of the memory units may include a hard disk drive (HDD), and a secure digital (SD) card.

INDUSTRIAL APPLICABILITY

During operation, the shearer 126 may move across the length, L, of the pan line 140, and may generally traverse between the first end stop 150' and the second end stop 150". During (or at the end of) a shear cycle, as the shearer 126 may travel towards the gate end 144, the first shoe 184 of the shearer 126 may gradually move towards the end stop 150 and may abut against the end stop 150. At this point, the shearer arm 200 may extend and may be disposed between the end stop 150 and the gate end 144, and thus the shearer 126 assumes the main gate position. Also, at this point, the shearer 126 may be positioned on the fourth pan 176 (i.e., when the first shearer arm 200 (or simply the shearer arm 200) is disposed between the end stop 150 and the gate end 144, as shown in FIG. 2). In the main gate position of the shearer 126, the shearer arm 200 operates to remove mine material from the mine face 108 disposed between the end stop 150 and the gate end 144. As, at the main gate position of the shearer 126, the central vertical axis 240 of the shearer 126 stops short of moving onto the third pan 174, the second pan 172, and the first pan 170, an orientation of the third pan 174, the second pan 172, and the first pan 170, remains unknown to the shearer 126 (and to the shearer arm 200) according to a conventional application. If the orientation of the section, P, and/or section, S, were unknown, according to a conventional application, an associated control system, such as the control system 128, may have had to generate/define a profile of the pan line 140 disposed between the end stop 150 and the gate end 144 (i.e., profile of section, P) by extrapolation. However, with such extrapolation there remained a possibility for the shearer 126 (and/or the shearer arm 200) to deviate from a desired floor/roof cut height of the underground mine 104, and may have caused the end pans 160 to develop uncontrolled roll angles which is difficult to recover.

Figure 3:
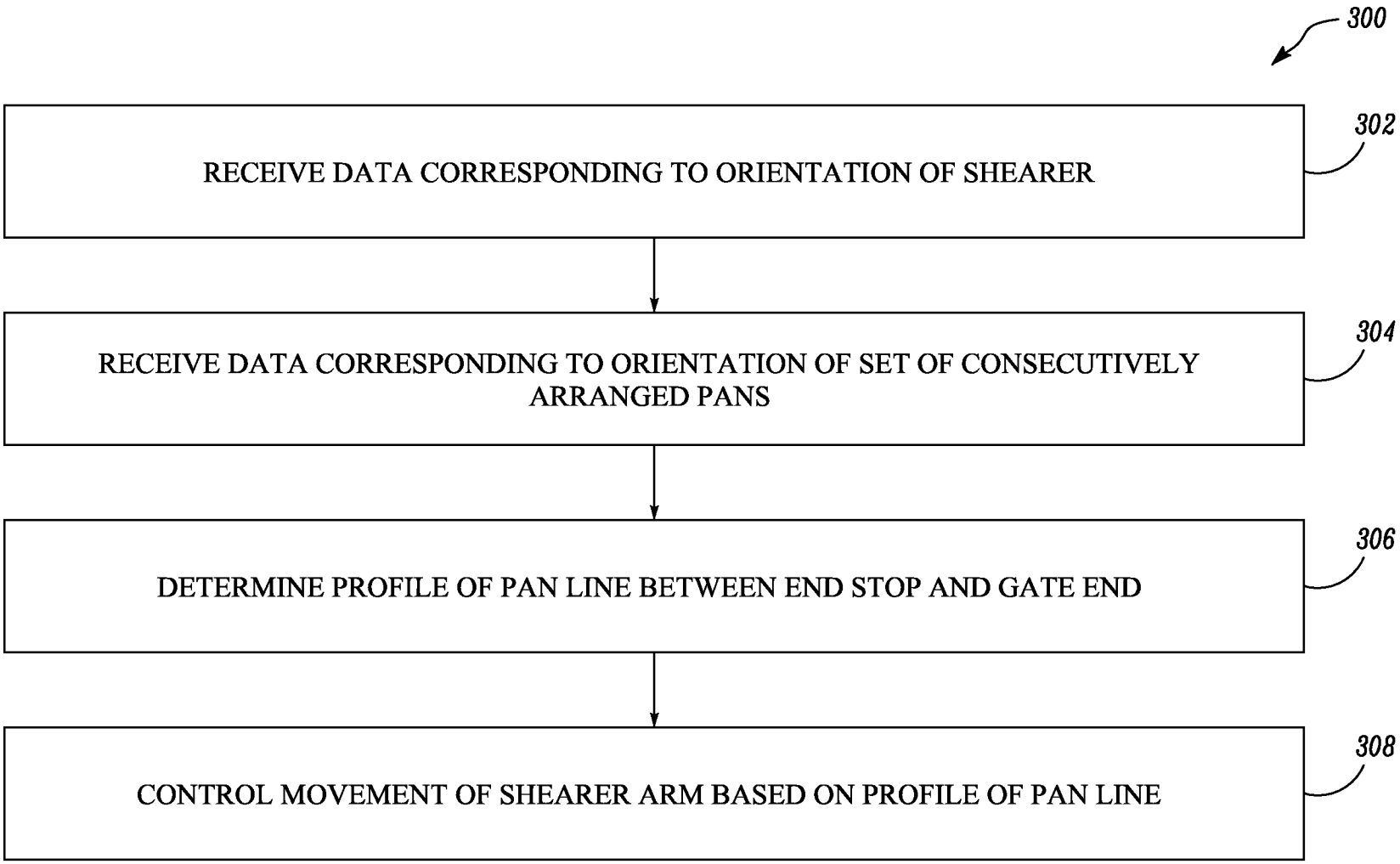
FIG. 3 is an exemplary method of operation of the shearing system, in accordance with an embodiment of the present disclosure.

It is an aspect of the preset disclosure to detect the orientation of the end pans 160 (e.g., of the third pan 174, the second pan 172, and the first pan 170 according to the depicted embodiment). To discuss said detection, the control system 128 utilizes data (or input) from the second sensors 222 coupled to each of the third pan 174, the second pan 172, and the first pan 170. To this end, the following description includes exemplary discussions related to a method 300 for operating the shearer 126. The method 300 has been discussed in conjunction with FIG. 3. The method 300 starts at step 302.

At step 302, the control system 128 receives data (or input) from the first sensor 212 related to the orientation of the shearer 126. This data (or input) may be related to an orientation (or a tilt) of the shearer 126 relative to one or more of the X-axis, Y-axis, and/or Z-axis (FIG. 1). At step 302, the control system 128 also receives data (or input) from the position sensor 218 related to a position of the shearer 126. This data (or input) may be related to a speed and a direction associated with shearer movement along the pan line 140. It may be noted that since the shearer 126 may halt movement at the end stop 150 (i.e., the main gate position), an orientation of the pans of the pan line 140 may be determined up to the point, A, defined on the fourth pan 176, or optionally up to the first shoe 184. Orientation of the remaining portion (untraversed by the shearer 126) of the pan line 140 till the gate end 144 may remain undetermined at step 302. The method 300 proceeds to step 304.

At step 304, the control system 128 receives data (or input) related to an orientation of the end pans 160 (i.e., the first pan 170, the second pan 172, the third pan 174, fourth pan 176, and the fifth pan 178) from the second sensors 222 associated with each of the end pans 160. Accordingly, orientation of the remaining portion (untraversed by the shearer 126) of the pan line 140 till the gate end 144 may be obtained. The method 300 proceeds to step 306.

At step 306, the control system 128 determines a profile of the pan line 140 from the first pan 170 all the way to the fifth pan 178, based on the orientation determined by the second sensors 222 of each of the first pan 170, the second pan 172, the third pan 174, fourth pan 176, and the fifth pan 178. In so doing, the control system 128 may determine both a profile of the pan line 140 defined between the point, A, and the end stop 150 (i.e., profile of section, S) and the profile of the pan line 140 between the end stop 150 and the gate end 144 (i.e., profile of section, P). In some embodiments, a profile of section, P, may be determined by determining an orientation of one or more of the end pans 160. For example, a profile of section, P, may be determined by the control system 128 by solely detecting the orientation of the first pan 170. The method 300 proceeds to step 308.

At step 308, the control system 128 controls a movement of the shearer arm 200 based on the profile of the pan line 140 disposed between the end stop 150 and the gate end 144 (i.e., profile of section, P) when the shearer arm 200 is disposed between the end stop 150 and the gate end 144 in the main gate position of the shearer 126. Optionally, the control system 128 may control a movement of the shearer arm 200 based on both section, P, and section, S. In that manner, the control system 128 negates the need to determine the profile of the pan line 140 disposed in between the end stop 150 and the gate end 144, or between point, A, and the gate end 144, by methods such as extrapolation—as an example, an exemplary extrapolated profile 246 of the pan line 140 in between the end stop 150 and the gate end 144 is depicted in FIG. 2. A variation (e.g., angular variation) between the profile defined by the section, P, and the exemplary extrapolated profile 246 may be seen in FIG. 2. As a result, the control system 128 keeps the shearer arm 200 from deviating from a desired floor/roof cut height associated with the underground mine 104, saves the shearer arm 200 from incorrect placement at the end of the pan line 140, and may keep the end pans 160 from developing uncontrolled roll angles which is difficult to recover. The method 300 ends at step 308.

In one example, at step 306, in the main gate position of the shearer 126, apart from determining a profile of the end pans 160 based on the orientation of the end pans 160 (as detected by corresponding second sensors 222), the control system 128 may also, additionally or optionally, determine the profile of the end pans 160 based on the orientation of the shearer 126 (as detected by the first sensor 212 and the position sensor 218) when the shearer 126 is positioned on the fourth pan 176. Since the orientation of the shearer 126 at the main gate position of the shearer 126, may also indicate an orientation of the fourth pan 176, the control system 128 may calculate a deviation between the orientation of the fourth pan 176 (as determined by the corresponding second sensor 222) and the orientation of the fourth pan 176 (as determined by the orientation of the shearer 126). For example, a value of orientation of the fourth pan 176, as determined by determining shearer orientation at the main gate position may differ from a value of orientation of the fourth pan 176 as determined by the second sensor 222 (e.g., fourth inclinometer 236) associated with the fourth pan 176. The deviation between the two values may be used to calibrate the values of orientation of the each of the end pans 160. Therefore, the control system 128 may further append an orientation of each of the end pans 160 based on the deviation, and, in that manner, the control system 128 may determine an actual (or a more accurate) profile of the pan line 140 defined between the gate end 144 and the end stop 150, or between the gate end 144 and point, A.

Since the above discussions are also contemplated between the control system 128 and the end pans at the tail gate end 146, the control system 128 may effectively determine the entire profile of the pan line 140 from the main gate end 144 to the tail gate end 146. In that manner, effectively, the control system 128 may also be able to control a movement of the second shearer arm 202 based on the profile of the pan line 140 when the second shearer arm 202 is disposed between the second end stop 150" and the tail gate end 146. An environment within the underground mine 104, as a result, becomes a more productive and efficient workplace for all stakeholders. Further, a service life of the shearer arms 200, 202 is also increased.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. A shearing system for longwall mining, the shearing system comprising:

a pan line defined by a plurality of interconnected pans extending along a longitudinal direction from a first gate end to a second gate end, the pan line including a first end stop disposed between the first gate end and the second gate end along the longitudinal direction, and a second end stop disposed between the first end stop and the second gate end along the longitudinal direction, the plurality of interconnected pans including a set of consecutively arranged pans extending from the first gate end toward the second gate end, at least one pan of the set of consecutively arranged pans being disposed between the first end stop and the first gate end;

a shearer moveable on and along the pan line, the shearer including:

a main body in contact with the plurality of interconnected pans, the main body being configured to stop at the first end stop, such that the first end stop prohibits contact between the main body and the at least one pan disposed between the first end stop and the first gate end, a shearer arm extending from the main body and configured to be moved relative to the main body to remove mine material from a mine face, wherein the main body is positioned on the set of consecutively arranged pans when the shearer arm is disposed between the first end stop and the first gate end, and a first sensor configured to detect an orientation of the shearer;

a set of second sensors, each sensor of the set of second sensors being configured to detect an orientation of a corresponding pan of the set of consecutively arranged pans; and a control system operatively coupled to the first sensor and the set of second sensors, the control system being configured to:

determine a profile of the pan line between the first end stop and the first gate end based on the orientation of one or more pans of the set of consecutively arranged pans and the orientation of the shearer when the shearer arm is disposed between the first end stop and the first gate end, and control a movement of the shearer arm based at least in part on the profile of the pan line between the first end stop and the first gate end when the shearer arm is disposed between the first end stop and the first gate end.

2. The shearing system of claim 1, wherein the first sensor includes an inertial navigation system.

3. The shearing system of claim 1, wherein the set of second sensors are coupled to the set of consecutively arranged pans, at least one sensor of the set of second sensors being coupled to a pan disposed between the first end stop and the first gate end.

4. The shearing system of claim 1, wherein each second sensor of the set of second sensors includes an inclinometer.

5. The shearing system of claim 1, wherein the first gate end is one of a main gate end or a tail gate end of the pan line.

6. The shearing system of claim 1, wherein a detection of the orientation of the shearer when the shearer arm is disposed between the first end stop and the first gate end facilitates a determination of the profile of the at least one pan disposed between the first end stop and the first gate end.

7. The shearing system of claim 1, wherein a length defined by the set of consecutively arranged pans extends up to at least a mid-point of a length of the shearer along the longitudinal direction, when the shearer arm of the shearer is disposed between the first end stop and the first gate end.

8. The shearing system of claim 1, wherein the control system is further configured to:

calculate a deviation between the orientation of one or more pans of the set of consecutively arranged pans and the orientation of the shearer when the shearer arm is disposed between the first end stop and the first gate end; and append the orientation of each pan of the set of consecutively arranged pans based on the deviation to determine the profile of the pan line between the first end stop and the first gate end.

9. A method for operating a shearer of a longwall mining machine, the method comprising:

receiving, by a control system, data corresponding to an orientation of the shearer moveable on and along a pan line, the pan line being defined by a plurality of interconnected pans extending along a longitudinal direction from a first gate end to a second gate end, the pan line including a first end stop disposed between the first gate end and the second gate end along the longitudinal direction, and a second end stop disposed between the first end stop and the second gate end along the longitudinal direction, the plurality of interconnected pans including a set of consecutively arranged pans extending from the first gate end toward the second gate end, at least one pan of the set of consecutively arranged pans being disposed between the first end stop and the first gate end, the first end stop prohibiting contact between a main body of the shearer and the at least one pan disposed between the first end stop and the first gate end;

receiving, by the control system, data corresponding to an orientation of the set of consecutively arranged pans;

determining, by the control system, a profile of the pan line between the first end stop and the first gate end based on the orientation of one or more pans of the set of consecutively arranged pans and the orientation of the shearer when a shearer arm of the shearer is disposed between the first end stop and the first gate end; and controlling, by the control system, a movement of the shearer arm based on the profile of the pan line when the shearer arm is disposed between the first end stop and the first gate end.

10. The method of claim 9, wherein data corresponding to the orientation of the shearer is received from a first sensor, and wherein the first sensor includes an inertial navigation system.

11. The method of claim 10, wherein the first sensor is coupled to the shearer.

12. The method of claim 9, wherein data corresponding to the orientation of the set of consecutively arranged pans is received from a set of second sensors, and wherein each second sensor of the set of second sensors includes an inclinometer.

13. The method of claim 12, wherein the set of second sensors is coupled to the set of consecutively arranged pans, at least one sensor of the set of second sensors being coupled to a pan disposed between the first end stop and the first gate end.

14. The method of claim 9, wherein the first gate end is one of a main gate end or a tail gate end of the pan line.

15. The method of claim 9, wherein a length defined by the set of consecutively arranged pans extends up to at least a mid-point of a length of the shearer along the longitudinal direction, when the shearer arm of the shearer is disposed between the first end stop and the first gate end.

16. The method of claim 9, wherein determining the profile of the pan line between the first end stop and the first gate end includes:

calculating, by the control system, a deviation between the orientation of one or more pans of the set of consecutively arranged pans and the orientation of the shearer when the shearer arm is disposed between the first end stop and the first gate end; and appending, by the control system, the orientation of each pan of the set of consecutively arranged pans based on the deviation to determine the profile of the pan line between the first end stop and the first gate end.

17. A shearing system for longwall mining, the shearing system comprising:

a pan line defined by a plurality of interconnected pans extending along a longitudinal direction from a first gate end to a second gate end, the pan line including a first end stop disposed between the first gate end and the second gate end along the longitudinal direction, and a second end stop disposed between the first end stop and the second gate end along the longitudinal direction, the plurality of interconnected pans including a set of consecutively arranged pans extending from the first gate end toward the second gate end, at least one pan of the set of consecutively arranged pans being disposed between the first end stop and the first gate end;

a shearer moveable on and along the pan line, the shearer including:

a main body in contact with the plurality of interconnected pans, the main body being configured to stop at the first end stop, such that the first end stop prohibits contact between the main body and the at least one pan disposed between the first end stop and the first gate end, a shearer arm extending from the main body and configured to be moved relative to the main body to remove mine material from a mine face, wherein the main body is positioned on the set of consecutively arranged pans when the shearer arm is disposed between the first end stop and the first gate end, and an inertial navigation system configured to detect an orientation of the shearer;

a set of inclinometers coupled to the set of consecutively arranged pans each inclinometer of the set of inclinometers being configured to detect an orientation of a corresponding pan of the set of consecutively arranged pans; and a control system operatively coupled to the inertial navigation system and the set of inclinometers, the control system being configured to:

determine a profile of the pan line between the first end stop and the first gate end based on the orientation of one or more pans of the set of consecutively arranged pans and the orientation of the shearer when the shearer arm is disposed between the first end stop and the first gate end, and control a movement of the shearer arm based on the profile of the pan line when the shearer arm is disposed between the first end stop and the first gate end.

18. The shearing system of claim 17, wherein the first gate end is one of a main gate end or a tail gate end of the pan line.

19. The shearing system of claim 17, wherein a length defined by the set of consecutively arranged pans extends up to at least a mid-point of a length of the shearer along the longitudinal direction, when the shearer arm of the shearer is disposed between the first end stop and the first gate end.

20. The shearing system of claim 17, wherein the control system is further configured to:

calculate a deviation between the orientation of one or more pans of the set of consecutively arranged pans and the orientation of the shearer when the shearer arm is disposed between the first end stop and the first gate end; and append the orientation of each pan of the set of consecutively arranged pans based on the deviation to determine the profile of the pan line between the first end stop and the first gate end.

* * * * *